US005848857A

United States Patent [19]

Killworth et al.

[11] Patent Number: 5,848,857

[45] Date of Patent: Dec. 15, 1998

[54] RAIN GUTTER SHIELD HAVING A POROUS, NON-WOVEN POLYMERIC FIBER SCREEN AND METHOD FORMING THE RAIN GUTTER SHIELD

[76] Inventors: Timothy J. Killworth, 14263 Volente Rd., Austin, Tex. 78641-9697; Donald D. Eisberg, 2492 S. Orchard View Dr., Green Valley, Ariz. 85614

[21] Appl. No.: 784,821

[22] Filed: Jan. 17, 1997

[51] Int. Cl.[6] ..... E02B 5/00; E04D 13/064

[52] U.S. Cl. ..... 405/118; 52/11; 210/474

[58] Field of Search ..... 405/118; 52/11, 52/12, 13; 248/48.1, 48.2; 210/503, 505, 508, 509, 473, 474

[56] References Cited

U.S. PATENT DOCUMENTS

| | | | |
|---|---|---|---|
| 3,855,132 | 12/1974 | Dugan | 210/455 |
| 4,116,761 | 9/1978 | Head | 162/152 |
| 4,553,356 | 11/1985 | Pepper | 51/11 |
| 4,727,689 | 3/1988 | Bosler . | |
| 4,769,957 | 9/1988 | Knowles | 52/12 |
| 4,841,686 | 6/1989 | Rees . | |
| 4,941,299 | 7/1990 | Sweers . | |
| 4,949,415 | 8/1990 | Weller | 52/12 |
| 4,959,932 | 10/1990 | Pfeifer . | |
| 5,056,276 | 10/1991 | Nielsen et al. . | |
| 5,092,086 | 3/1992 | Rognsvoog, Sr. . | |
| 5,133,864 | 7/1992 | Vaughn et al. | 210/437 |
| 5,271,191 | 12/1993 | Vahamaki . | |
| 5,321,920 | 6/1994 | Sichel . | |
| 5,375,379 | 12/1994 | Meckstroth . | |
| 5,398,464 | 3/1995 | Jacobs | 52/12 |
| 5,406,754 | 4/1995 | Cosby . | |
| 5,455,117 | 10/1995 | Nagano et al. | 428/545 |
| 5,555,680 | 9/1996 | Sweers | 52/12 |
| 5,618,510 | 4/1997 | Okada et al. | 423/346 |
| 5,640,810 | 6/1997 | Pieterson | 52/12 |
| 5,665,232 | 9/1997 | Schlegel | 210/408 |
| 5,682,740 | 11/1997 | Kawamura | 60/297 |

*Primary Examiner*—Tamara L. Graysay
*Assistant Examiner*—Jong-Suk Lee
*Attorney, Agent, or Firm*—Killworth, Gottman, Hagan & Schaeff, L.L.P.

[57] ABSTRACT

A rain gutter shield preferably having (a) an elongated layerless screen of porous, non-woven polymeric fiber material and (b) two elongated semi-rigid ribs on each lateral edge of the screen. One of the ribs may have a header portion thereon sized to fit under the shingles on the roof of the building on which the rain gutter is mounted. Alternatively, each rib may have a channel formed in the lateral edge of that rib which is not attached to the elongated layerless screen so that the channels snap fit over the edge of a rain gutter. The method of installation may involve not only the use of the preferred rib structure, but also simply gluing or bolting one lateral edge of the elongated layerless screen to the lip of the rain gutter most distant from the building to which the rain gutter is mounted and, then, attaching the other lateral edge of the elongated layerless screen to the roof of that building.

15 Claims, 6 Drawing Sheets

RAIN GUTTER SHIELD HAVING A POROUS, NON-WOVEN POLYMERIC FIBER SCREEN AND METHOD FORMING THE RAIN GUTTER SHIELD

BACKGROUND OF THE INVENTION

The present invention relates to a rain gutter shield and more particularly it relates to an improved rain gutter shield for maintaining rain gutters attached to a residence or other building in order to keep the rain gutter free from foreign debris such as dirt, gravel, twigs, leaves, pine needles and the like which would otherwise tend to collect therein.

Many devices, such as slotted or perforated metal sheets, or screens of wire or other material, have been used in the prior art to cover the open tops of rain gutters to filter out foreign material and prevent it from entering the gutter. Success with such devices has been limited because small pieces of foreign material, and even long pine needles are allowed to enter into the gutter and accumulate, thereby clogging the gutter drain, stopping the flow of water. Hence it is still necessary at intervals to open and clean the gutter.

Accordingly, it has been suggested to use layered structures such as ones having a layer of heavy gage, large mesh reinforcing screening and smaller gage, small mesh material facilitating the separation of dirt, gravel and twigs or the like from the water and preventing clogging. See, for example, U.S. Pat. No. 4,959,932 to Pfeifer. It is also known to use a pad of fibrous material such as fiberglass in such a layered screen. Thus in U.S. Pat. No. 4,841,686 to Rees there is disclosed an elongated screen to the underside of which is clamped a pad of fibrous material such as fiberglass. The pad of fibrous material is said to filter out even small pieces of foreign material.

While Pfeifer and Rees have to some extent solved the problem created by small pieces of foreign material, the layered structure of those prior art patents presents other problems in terms of ease of manufacturing, cost, ease of installation, etc. It would therefore be desirable to have a layerless, i.e. single layer, rain gutter shield which is easy to manufacture, relatively inexpensive, easy to install and yet serves the purpose of filtering out not only large but also small foreign material.

SUMMARY OF THE INVENTION

That need is met by the present invention which provides an inexpensive, easy to manufacture, easy to install, rain gutter shield which filters out not only large but also small foreign material, permitting only water and other easily washed-away materials to pass into the rain gutter. The rain gutter shield of the present invention has an elongated layerless screen of porous, non-woven polymeric fiber material. The elongated layerless screen has two lateral edges running the lengths thereof to which, in the preferred embodiments, elongated semi-rigid ribs are attached.

The porous, non-woven polymeric fiber material is preferably a ⅛" to ½" thick mat of silicon carbide-polyamide fiber/flint fiber. The elongated semi-rigid ribs are preferably made of a plastic material such as an extruded or molded thermoplastic. Both the porous, non-woven polymeric fiber material and the ribs may be colored to match the color of the roof of the building on which the rain gutter is mounted.

That is, the rain gutter shield of the present invention is designed to be attached over a rain gutter either at the time of mounting the rain gutter on a building or to be attached to already mounted rain gutters. For that purpose, a channel is formed in the outside lateral edge of at least one of the ribs, i.e. in the lateral edge of the rib which is not attached to the elongated layerless screen. That channel is sized to snap fit onto the edge of a rain gutter.

In one preferred embodiment such a channel is formed in the outside lateral edge of one of the ribs so that the rain gutter shield may be attached to a rain gutter by snap fitting the channel in the one rib on one edge of the open top of the rain gutter. The outside lateral edge of the other rib has a header portion integrally formed therein (or attached thereto). The header portion is, then, used to attach that edge of the rain gutter shield to the roof of the building on which the rain gutter is mounted. Preferably, the header portion is sized to fit under the shingles on the roof of the building. Such an arrangement usually results in a slanted surface for the rain gutter shield which helps deflect leaves, twigs, and other foreign matter.

However, the main filtering function is provided by the porous, non-woven polymeric fiber material itself. That material is weather resistant, flexible enough to be handled, but yet when reinforced with the semi-rigid ribs, sturdy enough to avoid sagging and stretching without the need for a backing layer of any kind. And, it quickly lets water and other liquids pass through it while excluding all but the finest of solid materials. Since it is a resilient mat, the ribs which are preferably thermoplastic may be attached to it by way of a pressure fit. they may also be attached by thermoforming techniques, with adhesives or with mechanical attachment means.

In an alternative preferred embodiment, a channel as described above is formed in the outside lateral edge of both of the ribs for attachment to the rain gutter by snap fitting the channel in the one rib on one edge of the open top of the rain gutter, and the channel in the other rib on the other edge of the open top of the rain gutter. If, then, the width of the elongated layerless screen exceeds the width of the open top in the rain gutter sufficiently, a resilient arch is formed when the rain gutter shield is attached to the rain gutter. The tension created by that resilient arch keeps the channels locked onto the edges of the rain gutter. It also provides a sloped surface for the rain gutter shield which like the slanted surface of the first embodiment helps deflect leaves, twigs, and other foreign materials.

Accordingly, it is an object of the present invention to provide an improved rain gutter shield which an elongated layerless screen and semi-rigid ribs on the lateral edges thereof so that the rain gutter shield can be easily installed for extended protection of the rain gutter from dirt, gravel, twigs, leaves, pine needles and the like which would otherwise tend to collect therein. It is also an object of the present invention to provide a method of forming a rain gutter shield with an elongated layerless screen, whether or not having semi-rigid ribs on the lateral edges thereof.

These, and other objects and advantages of the present invention, will become apparent from the following detailed description and the accompanying claims.

DETAILED DESCRIPTION OF THE PREFERRED EMBODIMENTS

Figure 1:
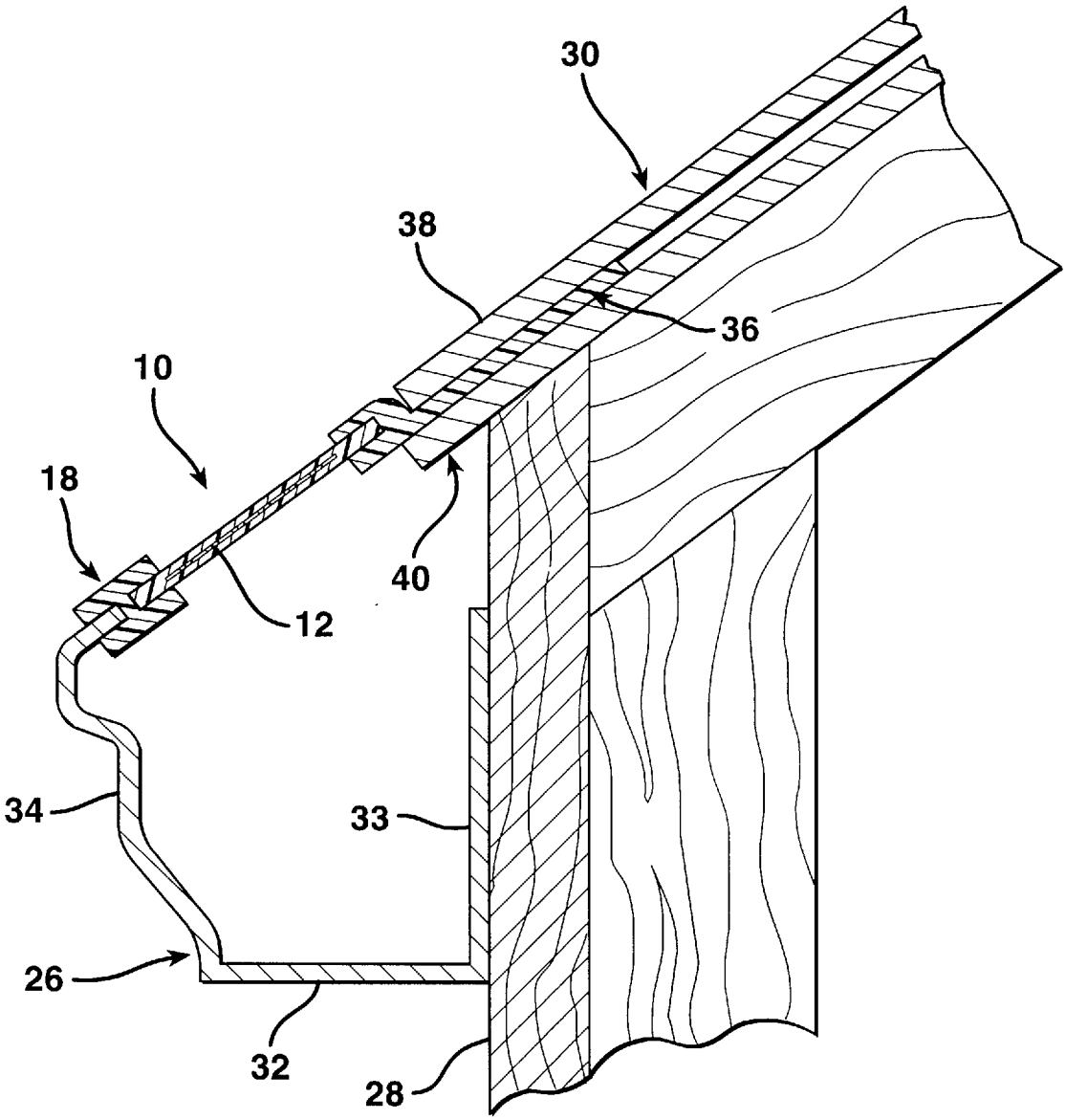
FIG. 1 is a cross-sectional view of the rain gutter shield of the first embodiment of the present invention as attached to a rain gutter and the roof of a building onto which the rain gutter has been mounted.
Figure 2:
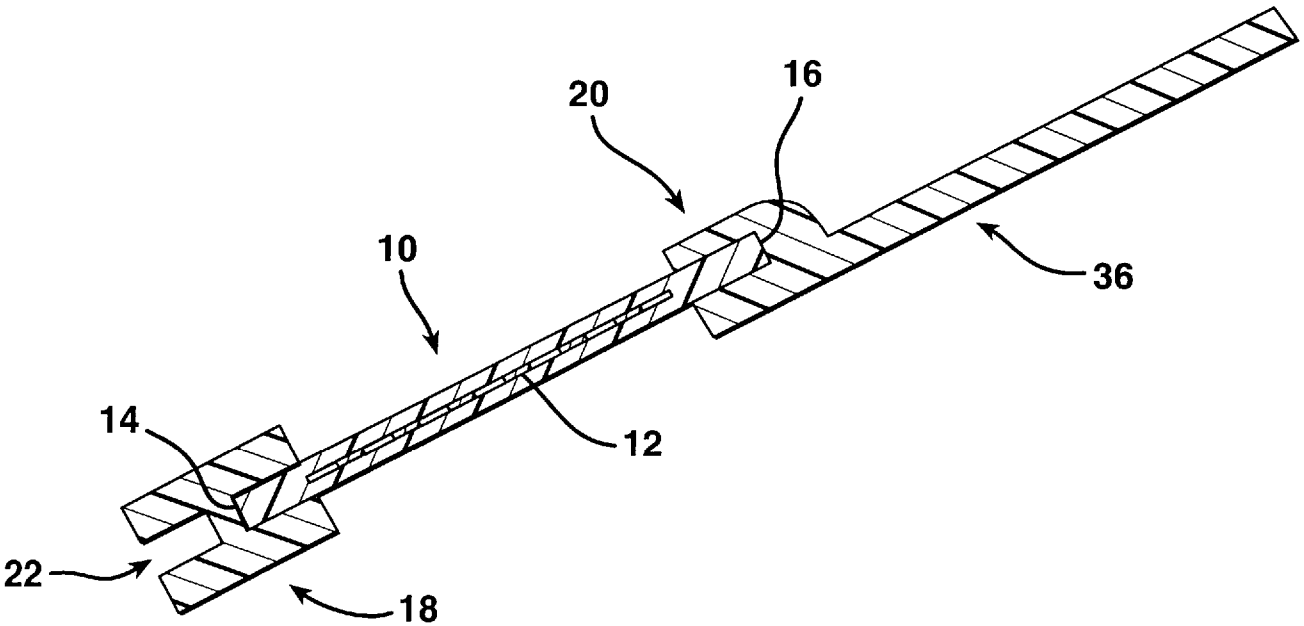
FIG. 2 is a cross-sectional view of the rain gutter shield of the first embodiment.

In FIGS. 1 and 2, there is shown a rain gutter shield 10 having an elongated layerless screen 12 of porous, non-woven polymeric fiber material and a first lateral edge 14 and a second lateral edge 16 running the length of that material. A first, elongated, semi-rigid rib 18 is attached to lateral edge 14 and a second, elongated, semi-rigid rib 20 is attached to lateral edge 16. A channel 22 is formed in the outside lateral edge of rib 18. A header portion 36 is formed on the outside lateral edge of rib 20. As shown in FIG. 2, header portion 36 is formed integrally with rib 20 during the extrusion or molding of rib 20. However, it should be recognized that header portion 36 may be a separate plastic or metal piece attached to rib 20 by adhesives or mechanical attachment means.

While channel 22 is used to attach rib 18 to one edge of rain gutter 26 as shown in FIG. 1, header portion 36 is used to attach rib 20 to the roof 30 of the building. That is, header portion 36 is sized to fit under shingles 38 so that it is sandwiched between shingles 38 and bottom shingle row or roof base 40. In this embodiment, the widths of rain gutter shield 10 is sufficient to cover in a rectilinear fashion the open top of rain gutter 26 as shown. Three, four, five and six inch widths may be used as necessary. The slant of the rain gutter shield shown in FIG. 1 is formed by the attachment system. Because of the "sandwiching" of header portion 36 as shown, tension is created which holds ribs 18 and 20 firmly in place.

As shown in FIG. 1 rain gutter 26 is mounted along sidewall 28 of the building just beneath roof 30. Rain gutter 26 may be a conventional gutter of roll formed sheet metal, such as aluminum. It includes a flat horizontal bottom wall 32 which integrally connects a flat vertical rear wall 33 to a curved or contoured front wall 34. Other rain gutter shapes may also be used.

The elongated layerless screen 10 is, as mentioned, made of a porus, non-woven polymeric fiber material such as a silicon carbide/Nylon(polyamide) fiber/flint fiber material of the type available as SCOTCH-BRIGHT non-woven fiber material or CLEAN & FINISH ROLL non-woven fiber material rolls from 3M Company of St. Paul, Minn., or such as silicon carbide/Nylon/aluminum oxide fiber material of the type available as BEAR-TEX non-woven fiber material from Norton Company of Worcester, Mass. Those materials can be purchased in roll form (currently 30 foot lengths) and may have a thickness of ⅛ inch to ½ inch. They may be cut into various lengths (5, 10, 15 feet, etc.) and used to manufacture a rain gutter shield 10 of any desired length.

Figure 3:
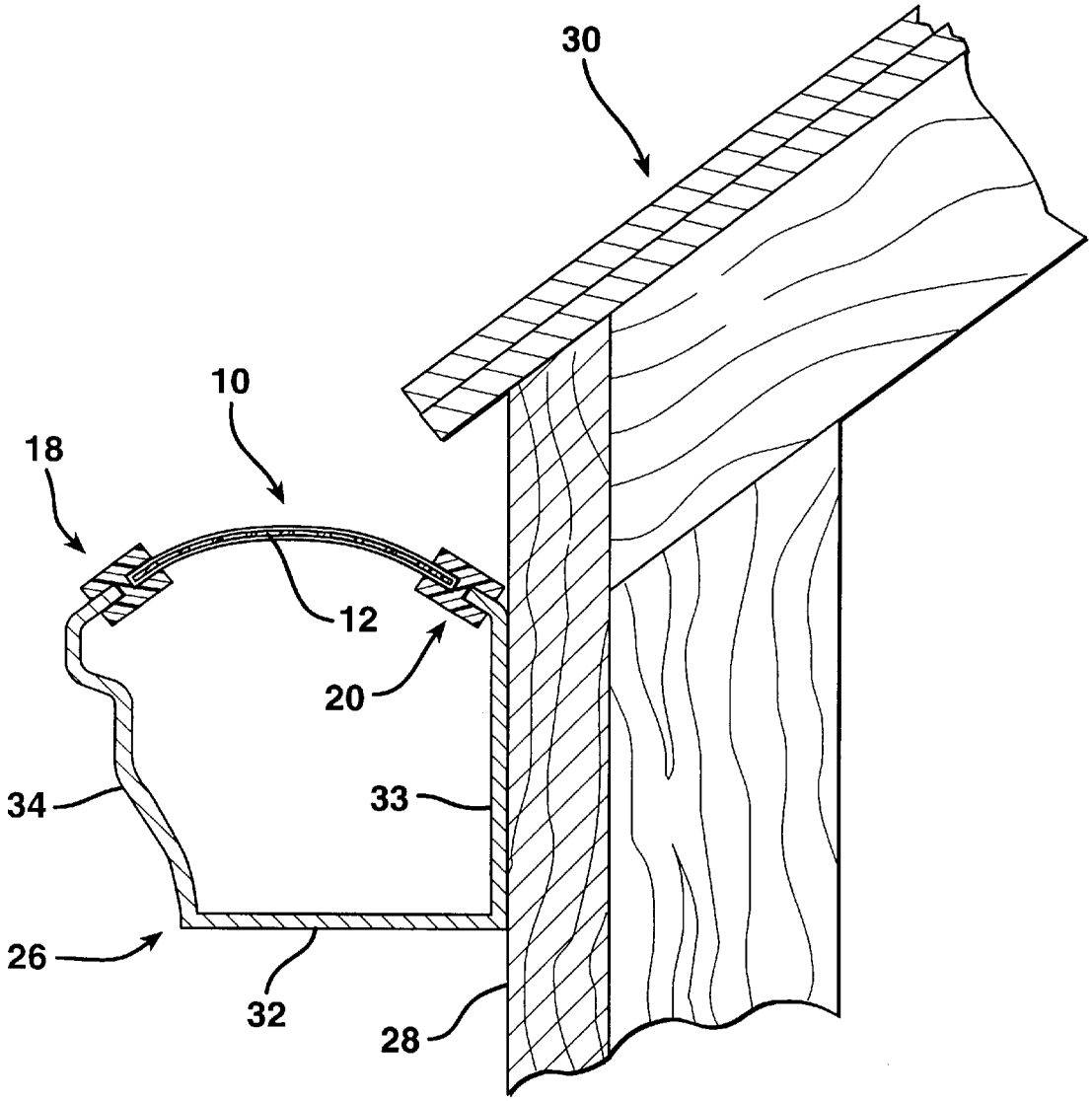
FIG. 3 is a cross-sectional view of the rain gutter shield of the second embodiment of the present invention as attached to a rain gutter which has been mounted along a sidewall of a building.
Figure 4:
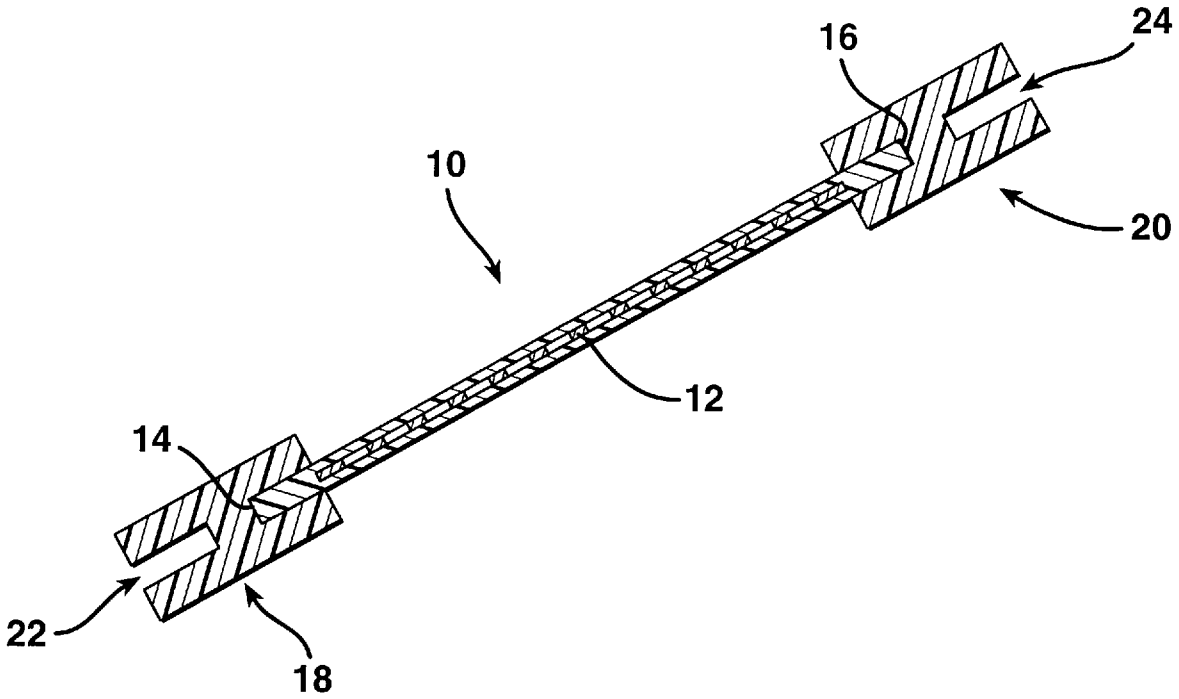
FIG. 4 is a cross-sectional view of the rain gutter shield of the second embodiment of the present invention.

FIGS. 3 and 4 show another embodiment of the invention, where like numerals have been used for like elements. Thus, as in FIGS. 1 and 2, there is shown a rain gutter shield 10 having an elongated layerless screen 12 of porous, non-woven polymeric fiber material and first and second lateral edges 14 and 16. Ribs 18 and 20 are attached to lateral edges 14 and 16 as previously described. A channel 22 is formed in the outside lateral edge of rib 18.

In this embodiment, a channel 24 is formed in the outside lateral edge of rib 20 as shown in FIG. 4, channels 22 and 24 are adopted to be attached to the edges of the open top of rain gutter 26 as shown in FIG. 3.

The width of the rain gutter shield 10 in this embodiment is sized so that it exceeds the width of the open top of rain gutter 26. For example, a conventional rain gutter has an open top width of around five (5) inches. In that instance, the rain gutter shield 10 should be 5 ¼ to 6 inches wide so that when attached to the rain gutter the flexible, elongated layerless screen 12 forms a resilient arch as shown in FIG. 3.

In both preferred embodiments, ribs 18 and 20 are sufficiently semi-rigid to hold the elongated, layerless screen 12 in place over the open top of rain gutter 26. Preferably ribs 18 and 20 are extruded or molded out of a thermoplastic material such as polyvinyl chloride or a polyolefin resin. Channel 22 and channel 24, if used, may be formed during the extruding or molding process. Of course, other semi-rigid materials such as other plastics or sheet metal may be used to form ribs 18 and 20.

As shown rib 18 is attached to lateral edge 14 and rib 20 is attached to lateral edge 16 by way of a pressure fit. That is, the running length attachment openings in ribs 18 and 20 are smaller than the thickness of elongated, layerless screen 12 so that when snap-fit onto lateral edges 14 and 16, the resilient pressure of the semi-rigid thermoplastic material tightly grips elongated, layerless screen 12. For example, with a ¼" thick mat of porous, non-woven polymeric fiber material, the attachment openings in ribs 18 and 20 may be 1/16" wide in a normal, relaxed state. Alternatively, adhesives or mechanical attachment means may be used to attach ribs 18 and 20 to lateral edges 14 and 16.

Figure 5:
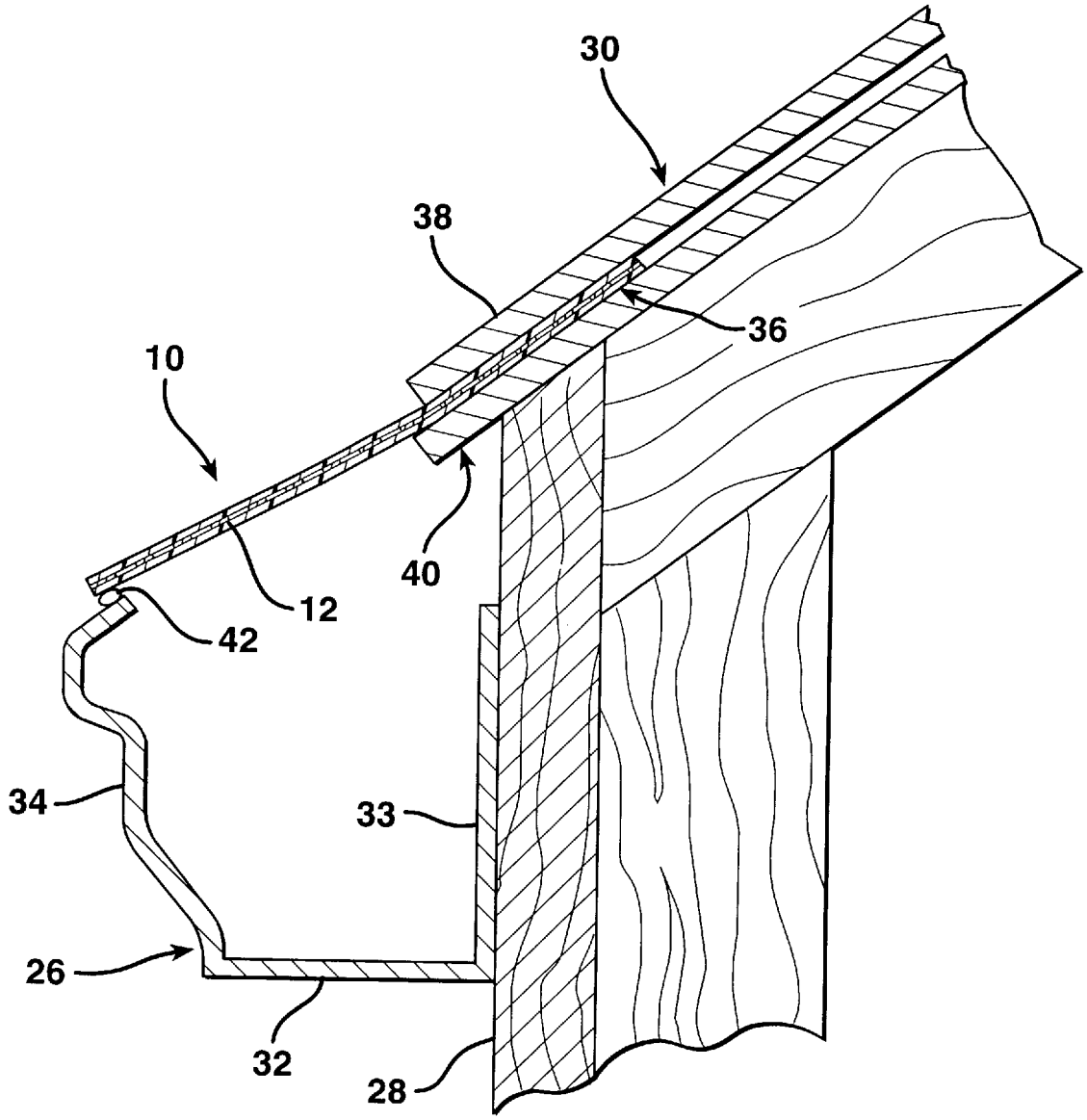
FIG. 5 is a cross-sectional view of the rain gutter shield of a third embodiment, installed without the aid of semi-rigid ribs as in the first two embodiments.
Figure 6:
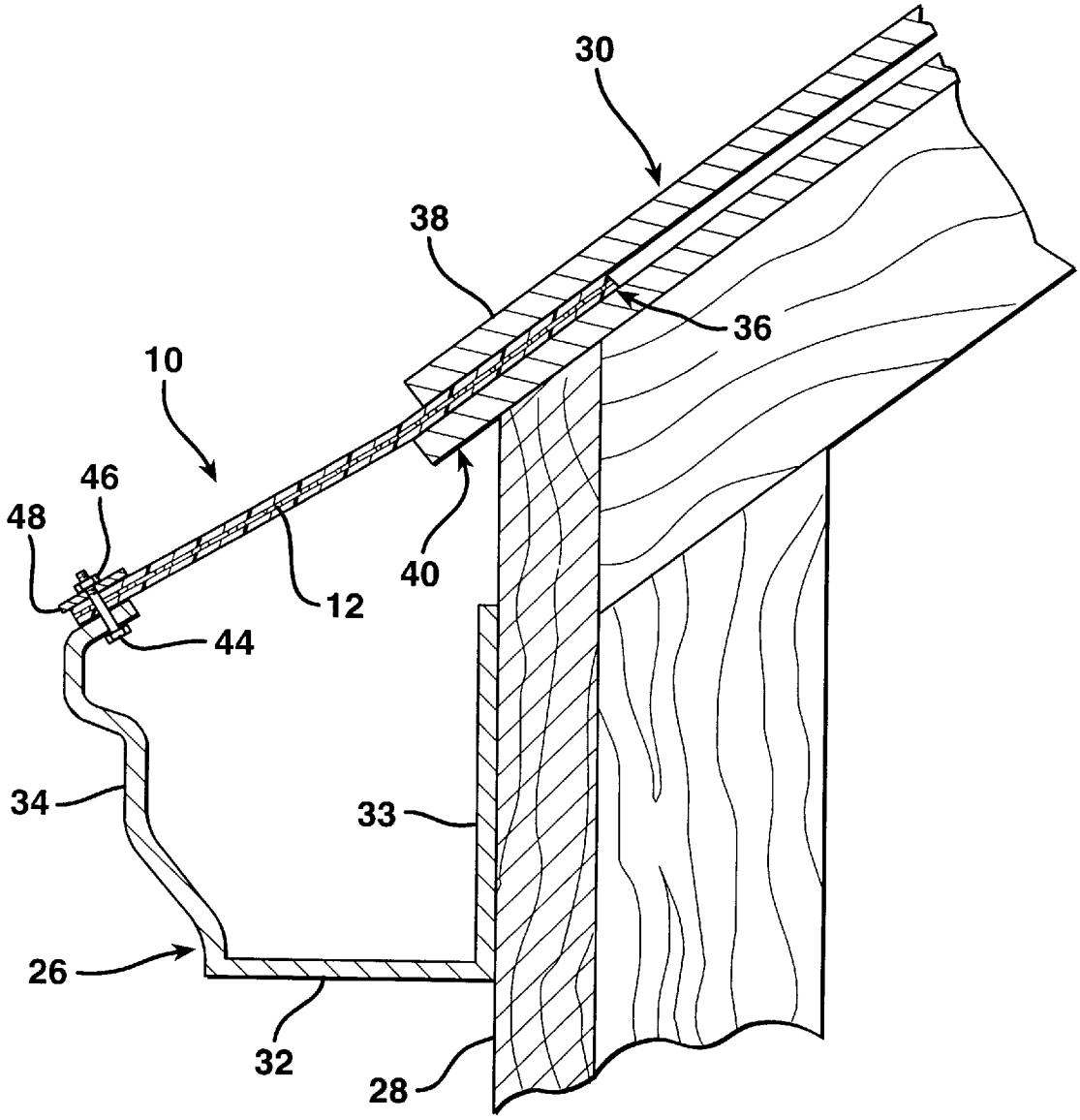
FIG. 6 is a cross-sectional view of the rain gutter shield of a fourth embodiment, installed without the semi-rigid ribs of the first two embodiments, but in a different manner than shown in FIG. 5.

While not a preferred embodiment, it is also possible to form a rain gutter shield by attaching an elongated layerless screen of porous, non-woven polymeric material to a rain gutter without the use of ribs 18 and 20. This embodiment is illustrated by FIGS. 5 and 6 where lateral edge 14 of the elongated layerless screen 12 is glued (FIG. 5) or bolted (FIG. 6) to the lip of front wall 34 of rain gutter 26. When glued, a bead of adhesive caulking 42, such as a silicone adhesive caulking, may be placed on the lip and edge 14 of the elongated layerless screen pressed into that bead of adhesive caulking until the adhesive caulking sets. When bolted, bolts 44 and nuts 46 (or an equivalent attachment device such as rivets, staples, etc.) may be used, with or without tack strip 48 (which may be wood, metal or plastic). In the FIGS. 5 and 6 embodiments, edge 16 of the elongated layerless screen 12 may be wedged under the shingles 38 on the roof 30 of the building to which the rain gutter is mounted in the same manner that header portion 36 is so wedged as shown in FIG. 1.

In all embodiments, once installed rain gutter shield 10 easily permits rain water and other liquids to run through it into rain gutter 26 and down the gutter drain (not shown). Yet, the elongated, layerless screen 12 keeps leaves and other debris from entering rain gutter 26. Unlike other gutter shields (such as perforate metal or plastic screens), the elongated,layerless screen 12 of rain gutter shield 10 actually stops leaves, leaf stems, seeds, or debris from collecting in the holes in the screen and blocking rain water from entering the rain gutter. Leaves normally blow off most roofs with any slope when dry. When installed as in FIGS. 1, 3, 5 and 6 rain gutter shield 10 has the same slope as roof 30 and leaves, when dry, will blow off rain gutter shield 10 as they do on most roofs. The slope of the resilient arch of rain gutter shield 10 as shown in FIGS. 3 and 4 serves the same purpose.

Having described the invention in detail and by reference to the preferred embodiments thereof, it will be apparent that modifications and variations are possible without departing from the scope of the invention defined in the appended claims.

What is claimed is:

1. A rain gutter shield comprising (a) an elongated layerless screen of porous, non-woven polymeric fiber material having first and second lateral edges running along the opposite sides of the length of said elongated layerless screen and (b) first and second elongated semi-rigid ribs, the first rib attached to the first of said lateral edges of said elongated layerless screen, and the second rib attached to the second of said lateral edges of said elongated layerless screen whereby said rain gutter shield may be attached by at least one of said ribs to a rain gutter, said elongated layerless screen of porous, non-woven polymeric fiber material being weather resistant, flexible enough to be handled, but yet when reinforced with said first and second elongated semi-rigid ribs, sturdy enough to avoid sagging and stretching without the need for a backing layer of any kind.

2. The rain gutter shield of claim 1 wherein said porous, non-woven polymeric fiber material is ⅛" to ½" thick.

3. The rain gutter shield of claim 2 wherein said porous, non-woven polymeric fiber material has a color which matches the color of a roof of a building to which the rain gutter is mounted.

4. The rain gutter shield of claim 3 wherein said ribs also have a color which matches the color of said porous, non-woven polymeric material.

5. The rain gutter shield of claim 1 wherein said ribs are made of a plastic material.

6. The rain gutter shield of claim 5 wherein said ribs are made of an extruded or molded semi-rigid thermoplastic material.

7. The rain gutter shield of claim 6 wherein the width of said elongated layerless screen exceeds the width of the open top in a rain gutter so that when said rain gutter shield is attached to said rain gutter said elongated layerless screen forms a resilient arch.

8. The rain gutter shield of claim 5 wherein said first rib and said second rib each have a channel formed in the lateral edge of that rib which is not attached to said elongated layerless screen, said channel being adapted to fit the edge of said rain gutter, whereby said rain gutter shield may be attached to said rain gutter thereby.

9. The rain gutter shield of claim 5 wherein said first rib has a channel formed into the lateral edge of that rib which is not attached to said elongated layerless screen, and said second rib has a header portion on the lateral edge of that rib which is not attached to said elongated layerless screen, whereby said first rib may be used to attach one edge of said rain gutter shield to said rain gutter and said second rib may be used to attach the other edge of said rain gutter shield to a roof of a building to which said rain gutter is mounted.

10. The rain gutter shield of claim 9 wherein said header portion is sized to fit under the shingles on the roof of the building on which said rain gutter is mounted.

11. A method of forming a rain gutter shield over a rain gutter comprising:

a) providing an elongated layerless screen of porous, non-woven polymeric fiber material having first and second lateral edges running along the opposite sides of the length of said elongated layerless screen, b) providing a building having a rain gutter mounted thereon beneath a roof which has shingles thereon, said rain gutter having a front wall with a lip;

c) attaching said first lateral edge of said elongated layerless screen to said lip of the front wall of said rain gutter, and d) attaching said second lateral edge of said elongated layerless screen to said roof of said building, said elongated layerless screen of porous, non-woven polymeric material being weather resistant, flexible enough to be handled, but yet when attached to said rain gutter and to said roof sturdy enough to avoid sagging and stretching without the need for a backing layer of any kind.

12. The method of claim 11 wherein said porous, non-woven polymeric fiber material is ⅛" to ½" thick.

13. The method of claim 11 wherein said first lateral edge of said elongated layerless screen is glued to said lip of the front wall of said rain gutter.

14. The method of claim 11 wherein said first lateral edge of said elongated layerless screen is bolted to said lip of the front wall of said rain gutter.

15. The method of claim 11 wherein said second lateral edge of said elongated layerless screen is wedged under the shingles on the roof of said building.

* * * * *